US010042307B2

(12) United States Patent
Kitamura

(10) Patent No.: US 10,042,307 B2
(45) Date of Patent: Aug. 7, 2018

(54) SHEET POST-PROCESSING APPARATUS AND IMAGE FORMING SYSTEM INCLUDING SHEET POST-PROCESSING APPARATUS

(71) Applicant: KONICA MINOLTA, INC., Chiyoda-ku, Tokyo (JP)

(72) Inventor: Kei Kitamura, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/420,552

(22) Filed: Jan. 31, 2017

(65) Prior Publication Data

US 2017/0219984 A1 Aug. 3, 2017

(30) Foreign Application Priority Data

Feb. 3, 2016 (JP) ..... 2016-019236

(51) Int. Cl.
*B65H 29/58* (2006.01)
*B65H 29/60* (2006.01)
(Continued)

(52) U.S. Cl.
CPC ..... *G03G 15/6582* (2013.01); *B65H 29/125* (2013.01); *B65H 29/14* (2013.01); *B65H 29/58* (2013.01); *B65H 29/60* (2013.01); *B65H 31/24* (2013.01); *B65H 37/00* (2013.01); *G03G 15/6552* (2013.01); *G03G 15/6573* (2013.01);
(Continued)

(58) Field of Classification Search
CPC ..... B65H 31/24; B65H 29/58; B65H 29/60; B65H 39/11; B65H 2301/332; B65H 2301/333; G03G 15/6552; G03G 15/234
See application file for complete search history.

(56) References Cited

U.S. PATENT DOCUMENTS 5,852,764 A * 12/1998 Kida ..... B65H 29/60 271/288
6,739,818 B2 * 5/2004 Aguirre ..... B42C 1/12 270/52.18
(Continued)

FOREIGN PATENT DOCUMENTS

JP 08169626 A 7/1996
JP 2002160861 A 6/2002
JP 2015020873 A * 2/2015

*Primary Examiner* — Luis A Gonzalez
(74) *Attorney, Agent, or Firm* — Cantor Colburn LLP

(57) ABSTRACT

A sheet post-processing apparatus includes a sheet introducing unit, a first sheet discharge unit, a second sheet discharge unit, a sheet processing unit, a sheet conveyance unit, and a control unit. The first and the second sheet discharge unit are configured to be able to discharge a sheet to an outside. The sheet conveyance unit includes a sheet conveyance path arranged between the first sheet discharge unit and the second sheet discharge unit. The control unit controls the sheet conveyance unit to convey the sheet along the sheet conveyance path toward the first sheet discharge unit to a predetermined position at which the sheet is not discharged from the first sheet discharge unit to the outside, then convey the sheet along the sheet conveyance path in an opposite direction toward the second sheet discharge unit, and discharge the sheet from the second sheet discharge unit.

6 Claims, 6 Drawing Sheets

(51) Int. Cl.

| | |
|---|---|
| ***B65H 31/24*** | (2006.01) |
| ***G03G 15/00*** | (2006.01) |
| ***B65H 29/14*** | (2006.01) |
| ***B65H 37/00*** | (2006.01) |
| ***B65H 29/12*** | (2006.01) |

(52) U.S. Cl.

CPC ..... *G03G 15/6576* (2013.01); *B65H 2301/33214* (2013.01); *B65H 2301/33312* (2013.01); *B65H 2301/5142* (2013.01); *B65H 2301/51256* (2013.01); *B65H 2511/11* (2013.01); *B65H 2513/42* (2013.01); *B65H 2801/27* (2013.01); *G03G 2215/007* (2013.01)

(56) References Cited

U.S. PATENT DOCUMENTS

| | | | | |
|---|---|---|---|---|
| 7,055,820 | B2 * | 6/2006 | Saito ..... | B65H 29/60 271/298 |
| 2016/0368726 | A1 * | 12/2016 | Hayakawa ..... | B65H 29/60 |
| 2017/0036880 | A1 * | 2/2017 | Tokuma ..... | B65H 45/18 |

* cited by examiner

SHEET POST-PROCESSING APPARATUS AND IMAGE FORMING SYSTEM INCLUDING SHEET POST-PROCESSING APPARATUS

CROSS-REFERENCE TO RELATED APPLICATION

This application is based on Japanese Patent Application No. 2016-019236 filed on Feb. 3, 2016, the contents of which are incorporated herein by reference.

BACKGROUND

1. Technical Field

The present invention relates to a sheet post-processing apparatus and an image forming system including the sheet post-processing apparatus.

2. Description of the Related Art

Sheet post-processing apparatuses have been known which have functions of performing post-processing, such as curl correction, humidification, sheet folding, stapling, and punching, on sheets on which images are formed by image forming apparatus main bodies. Such sheet post-processing apparatuses may be required to reverse front and back sides of sheets subjected to the post-processing and discharge the sheets to the outside in some cases. As an apparatus for reversing front and back sides of a sheet, for example, a sheet reversing device described in Japanese Unexamined Publication No. 2002-160861 is known. However, if the sheet reversing device according to Japanese Unexamined Publication No. 2002-160861 is installed as it is in a sheet post-processing apparatus, the sheet post-processing apparatus is enlarged, and a sheet processing speed may be lowered.

In this connection, Japanese Unexamined Publication No. 8-169626 discloses a technique for reversing front and back sides of a sheet in a sheet post-processing apparatus in which the sheet is partially and temporarily discharged from a route for discharging the sheet to a sheet discharge tray, then pulled back to reverse the front and back sides of the sheet, and conveyed. Therefore, when the technique according to Japanese Unexamined Publication No. 8-169626 is used in the sheet post-processing apparatus, front and back sides of a sheet can be reversed and the sheet can be discharged to the outside without causing enlargement of the apparatus.

However, the technique according to Japanese Unexamined Publication No. 8-169626 has a risk that a user may mistakenly take out the sheet temporarily discharged on the sheet tray. In addition, when a corrugation roller is used to stiffen a sheet, there is a risk that the sheet is wrinkled when being discharged and pulled back. Further, there is a risk that positions of sheets stacked on the sheet discharge tray in an aligned state may be disordered. Furthermore, there is a risk that when a sheet is discharged and pulled back at a high speed, a part of the sheet discharged to a sheet discharge port may be curled up by receiving air resistance or wrinkled when being pulled back.

The present invention is made in view of the above-mentioned problems. One of the objects of the present invention is to provide a sheet post-processing apparatus capable of discharging a sheet by stably reversing front and back sides thereof without causing enlargement of the apparatus and a decrease in productivity.

SUMMARY

To achieve at least one of the above-mentioned objects, a sheet post-processing apparatus reflecting one aspect of the present invention has a function of performing predetermined processing on a sheet introduced from the outside, then reversing front and back sides of the sheet, and discharging the sheet to the outside. The sheet post-processing apparatus includes a sheet introducing unit configured to introduce a sheet, a first sheet discharge unit configured to be able to discharge the sheet to the outside, a second sheet discharge unit located below the first sheet discharge unit and configured to be able to discharge the sheet to the outside, a sheet processing unit configured to perform the predetermined processing on the sheet, a sheet conveyance unit which includes a sheet conveyance path arranged between the first sheet discharge unit and the second sheet discharge unit and is configured to convey the sheet through the sheet conveyance path, and a control unit configured to, in the case where front and back sides of the sheet are reversed and the sheet is discharged from the second sheet discharge unit to the outside, control the sheet conveyance unit to convey the sheet along the sheet conveyance path toward the first sheet discharge unit to a predetermined position at which the sheet is not discharged from the first sheet discharge unit to the outside, then convey the sheet along the sheet conveyance path in an opposite direction toward the second sheet discharge unit, and discharge the sheet from the second sheet discharge unit.

Preferably, the first sheet discharge unit includes a sheet retreating unit configured to retreat the conveyed sheet toward a direction different from a discharge route to the outside, and the control unit controls, in the case where a length of the sheet in a conveyance direction is longer than a predetermined length, the sheet conveyance unit and the first sheet discharge unit to convey the sheet toward the sheet retreating unit, temporarily retreat a part of the sheet in the sheet retreating unit, then convey the sheet in an opposite direction toward the second sheet discharge unit, and discharge the sheet from the second sheet discharge unit.

Preferably, the first sheet discharge unit includes a switching gate configured to select whether to convey the sheet along the discharge route or whether to convey the sheet along a reversing route to the sheet retreating unit depending on the length of the sheet in the conveyance direction.

Preferably, the sheet conveyance path extends from the second sheet discharge unit to the first sheet discharge unit located above the second sheet discharge unit.

Preferably, the sheet processing unit is arranged below the sheet conveyance path.

Preferably, the sheet processing unit includes a curl correction unit configured to correct curl of the sheet.

The objects, features, and characteristics of this invention other than those set forth above will become apparent from the description given herein below with reference to preferred embodiments illustrated in the accompanying drawings.

DETAILED DESCRIPTION

The embodiments of this invention will be described below with reference to the accompanying drawings.

An Embodiment

Figure 1:
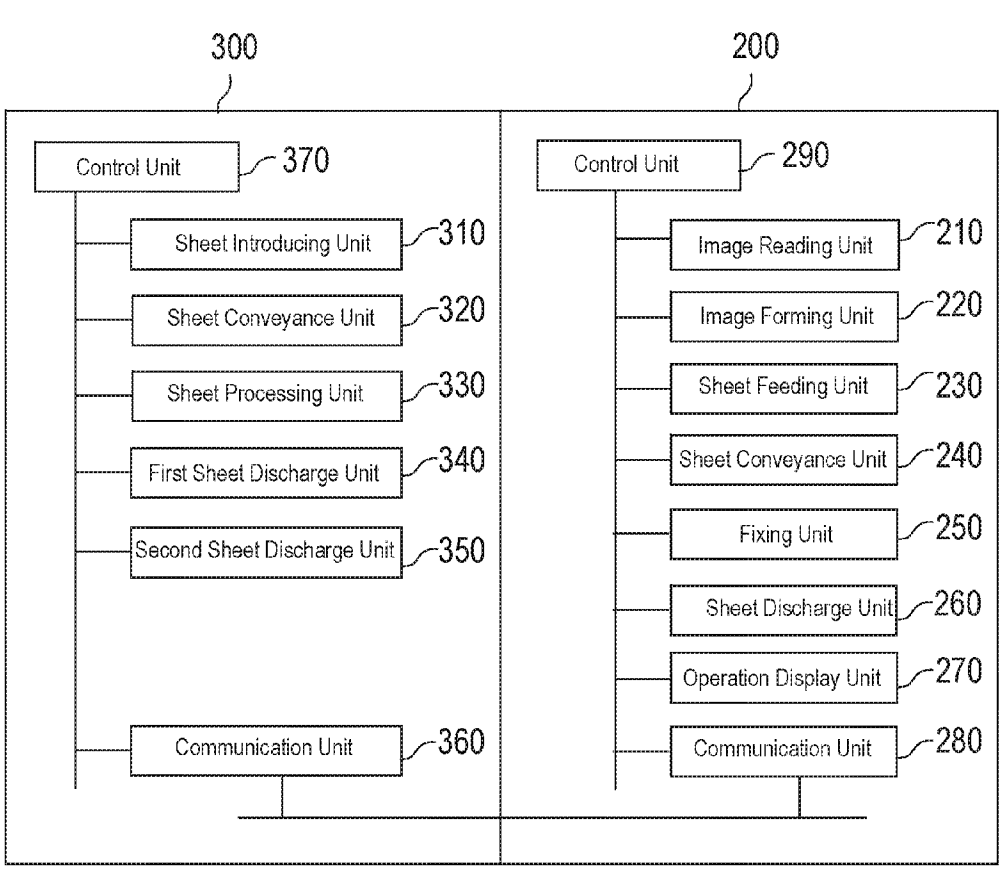
FIG. 1 is a schematic block diagram illustrating a configuration of an image forming system according to an embodiment.
Figure 2:
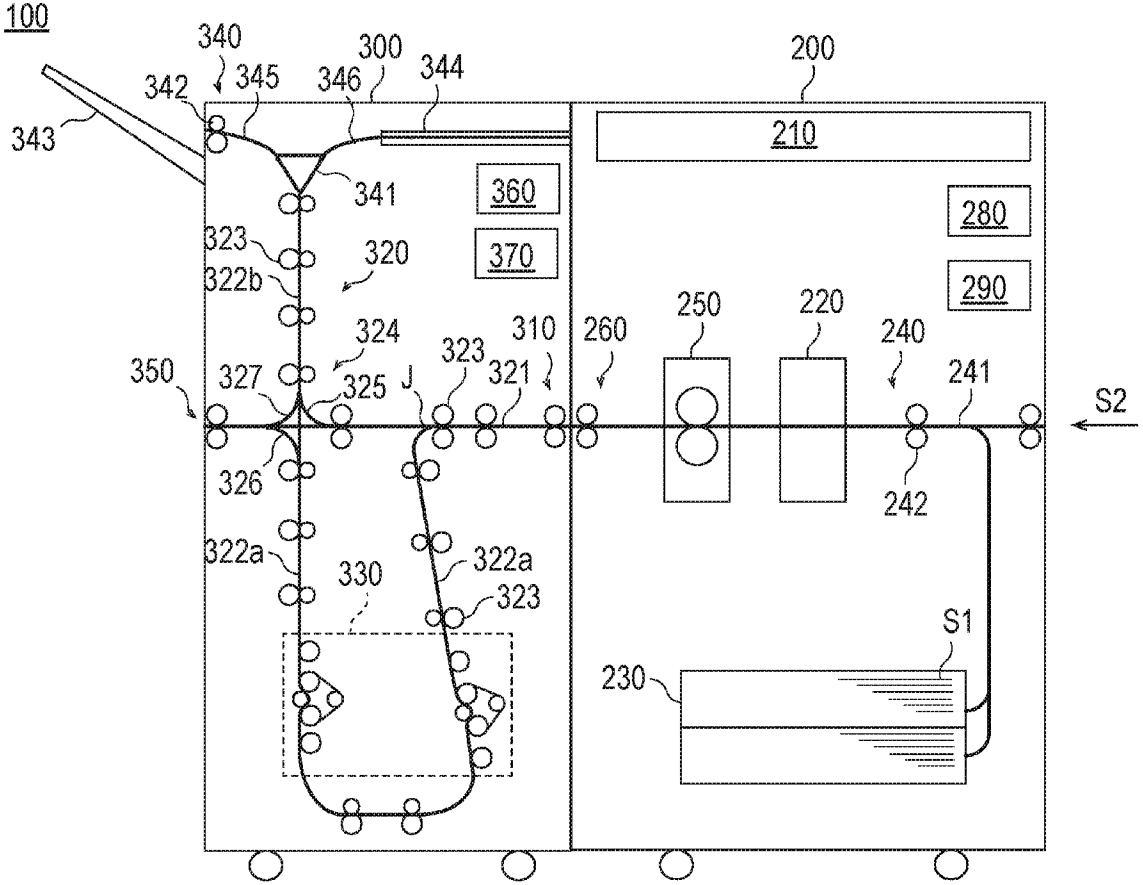
FIG. 2 is a schematic cross-sectional view schematically illustrating configurations of an image forming apparatus and a sheet post-processing apparatus illustrated in FIG. 1.

FIG. 1 is a schematic block diagram illustrating a configuration of an image forming system according to an embodiment. FIG. 2 is a schematic cross-sectional view schematically illustrating configurations of an image forming apparatus and a sheet post-processing apparatus illustrated in FIG. 1.

<Configuration of Image Forming System 100>

An image forming system 100 according to the present embodiment is a system constituted of a plurality of apparatuses including an image forming apparatus and a sheet post-processing apparatus connected to one another. The number of the image forming apparatuses and the sheet post-processing apparatuses included in the image forming system 100 are not limited. Further, types and the number of apparatuses other than the image forming apparatuses and the sheet post-processing apparatuses included in the image forming system 100 are not limited.

As illustrated in FIGS. 1 and 2, the image forming system 100 is described below as an example which includes a single image forming apparatus 200 and a single sheet post-processing apparatus 300 connected to the image forming apparatus 200 in series. Although it is not illustrated, the image forming apparatus 200 is connected to a sheet feeding apparatus on a side opposite to a side on which the sheet post-processing apparatus 300 is connected to the image forming apparatus 200. Another sheet post-processing apparatus can be further connected to a post-stage of the sheet post-processing apparatus 300. The image forming apparatus 200 and the sheet post-processing apparatus 300 according to the present embodiment are described in detail below.

<Configuration of Image Forming Apparatus 200>

The image forming apparatus 200 reads an image from a document and forms (prints) the read image on a sheet. Further, the image forming apparatus 200 receives print data and print setting data in a PDL (page description language) format from an external client terminal, such as a personal computer, via a network and forms an image on a sheet based on these data pieces.

The image forming apparatus 200 includes an image reading unit 210, an image forming unit 220, a sheet feeding unit 230, a sheet conveyance unit 240, a fixing unit 250, a sheet discharge unit 260, an operation display unit 270, a communication unit 280, and a control unit 290.

The image reading unit 210 reads an image on a document and generates print image data. The image reading unit 210 includes a light source, a reading surface, an optical system, and an image sensor. Light emitted from the light source including a light emitting element illuminates a document placed on the reading surface, and reflected light thereof passes through the optical system and forms an image on the image sensor moved to a reading position. The image sensor generates an electrical signal in response to a reflected light intensity from the document. The generated electrical signal is converted from an analog signal to a digital signal, subjected to various image processing, and transmitted to the image forming unit 220 as the print image data.

The image forming unit 220 forms and transfers a toner image to a sheet using an electrophotographic process. According to the present embodiment, an example of applying the electrophotographic process is described, however, other print methods, such as an ink jet method and a thermal sublimation method, may be applied without limiting to the above-mentioned one.

More specifically, the image forming unit 220 includes photosensitive drums (yellow (Y), magenta (M), cyan (C), and black (K)) and an intermediate transfer belt as image bearing members. The intermediate transfer belt is an endless belt which is wound around and supported by a plurality of rollers in a movable manner. The toner image of each color formed on the photosensitive drum (Y, M, C, and K) is sequentially transferred onto the intermediate transfer belt, and a toner image (a color image) obtained by superimposing each color (Y, M, C, and K) layers is formed on the intermediate transfer belt. A bias having a polarity opposite to that of the toner is applied to a transfer roller, and thus the toner image formed on the intermediate transfer belt is transferred onto a sheet.

The sheet feeding unit 230 supplies a cut sheet S1 as a sheet to the image forming unit 220. The sheet feeding unit 230 includes a plurality of sheet feeding trays and a plurality of rollers including sheet feeding rollers and delivery rollers disposed in each of the sheet feeding trays. Each sheet feeding tray stores the cut sheet S1 in advance for each type of a sheet (a type of paper, a weight, a sheet size, and the like), and the cut sheet S1 is conveyed one by one from an uppermost part toward the sheet conveyance unit 240.

The sheet conveyance unit 240 conveys the sheet in the image forming apparatus 200. The sheet conveyance unit 240 includes a sheet conveyance path 241 and a plurality of conveyance rollers 242. The sheet conveyance path 241 includes a guide member for guiding the conveyed sheet, and a plurality of the conveyance rollers 242 is arranged in pairs along the guide member. Each conveyance roller 242 includes a driving unit (not illustrated) and conveys the sheet along the sheet conveyance path 241 from an upstream side (the above-mentioned sheet feeding apparatus side) to a downstream side (the sheet post-processing apparatus 300 side) according to an instruction from the control unit 290.

The sheet conveyance unit 240 can take in a sheet S2 from the above-mentioned sheet feeding apparatus. The sheet S2 can be a sheet, for example, of which a length in a direction to which the sheet is conveyed (hereinbelow, referred to as a "sheet conveyance direction") is longer than that of a normal cut sheet S1 and shorter than about 500 mm. The cut sheet S1 supplied from the sheet feeding unit 230 or the sheet S2 taken in from the above-mentioned sheet feeding apparatus (hereinbelow, the cut sheet S1 and the sheet S2 are collectively referred to as the "sheet S") is conveyed to the image forming unit 220. The sheet S on which the toner image is transferred by the image forming unit 220 is conveyed along the sheet conveyance path 241 to the fixing unit 250 by the plurality of conveyance rollers 242.

The sheet conveyance unit 240 can include a sheet reversing unit (not illustrated). When the sheet conveyance unit 240 includes the sheet reversing unit, the sheet conveyance unit 240 can reverse front and back sides of the sheet S and then convey the sheet S to the sheet post-processing apparatus 300. Further, the sheet conveyance unit 240 can include a circulation route unit which reverses the front and back sides of the sheet S that passed through the fixing unit 250 and feeds the sheet S again to the image forming unit 220 of the image forming apparatus 200.

The fixing unit 250 heats the toner image transferred onto the sheet S and fixes the toner image on the sheet S. For example, the fixing unit 250 presses a pressing member to contact with a heating member as a heating source to apply heat and pressure at a fixing nip portion, and melts and fixes the toner image to the sheet S.

The sheet discharge unit 260 discharges the sheet S fixed by the fixing unit 250 to the outside of the image forming apparatus 200.

The operation display unit 270 receives user instructions and transmits the instructions to the control unit 290. The operation display unit 270 displays a warning, a message, and the like from the control unit 290 on a screen. The operation display unit 270 includes, for example, a touch panel, various switches, buttons, numeric keypads, and operation keys.

The communication unit 280 is an interface for communicating with other devices. The above-mentioned other devices include the above-mentioned sheet feeding apparatus, the sheet post-processing apparatus 300, a client terminal connected via a network, and the like.

The control unit 290 controls the image reading unit 210, the image forming unit 220, the sheet feeding unit 230, the sheet conveyance unit 240, the fixing unit 250, the sheet discharge unit 260, the operation display unit 270, and the communication unit 280.

The control unit 290 includes a CPU (central processing unit) as an arithmetic processing unit (not illustrated) and a RAM (random access memory) and a ROM (read only memory) as storage units (not illustrated). The control unit 290 further includes a hard disk drive or a flash memory as a large-capacity storage device (not illustrated).

The arithmetic processing unit executes a control program for the image forming apparatus 200 to output an instruction to each of the image reading unit 210, the image forming unit 220, the sheet feeding unit 230, the sheet conveyance unit 240, the fixing unit 250, the sheet discharge unit 260, the operation display unit 270, and the communication unit 280. The storage unit or the storage device stores the above-mentioned control program and information regarding the sheet S, for example, a type of paper, a weight, and a sheet size stored in the above-mentioned sheet feeding apparatus and the sheet feeding unit 230.

<Configuration of Sheet Post-Processing Apparatus 300>

According to the present embodiment, the sheet post-processing apparatus 300 is a sheet post-processing apparatus having a function of performing predetermined processing on a sheet introduced from an external apparatus, such as the image forming apparatus 200, then reversing the front and back sides of the sheet, and discharging the sheet to the outside. The sheet post-processing apparatus 300 includes a sheet introducing unit 310, a sheet conveyance unit 320, a sheet processing unit 330, a first sheet discharge unit 340, a second sheet discharge unit 350, a communication unit 360, and a control unit 370.

The sheet introducing unit 310 introduces the sheet S discharged from the sheet discharge unit 260 of the image forming apparatus 200. The sheet introducing unit 310 includes an introduction port for introducing the sheet S and a pair of conveyance rollers for conveying the introduced sheet S to the sheet conveyance unit 320.

The sheet conveyance unit 320 conveys the sheet in the sheet post-processing apparatus 300. The sheet conveyance unit 320 includes sheet conveyance paths 321 and 322 and a plurality of conveyance rollers 323. The sheet conveyance paths 321 and 322 include guide members for guiding the conveyed sheet S, and a plurality of the conveyance rollers 323 is arranged in pairs along the guide members. Each conveyance roller 323 includes a driving unit (not illustrated) and conveys the sheet S along the guide member by rotating according to an instruction from the control unit 370.

The sheet conveyance path 321 is a sheet conveyance path which is arranged between the sheet introducing unit 310 and the second sheet discharge unit 350 for conveying the sheet S in a direction from the sheet introducing unit 310 toward the second sheet discharge unit 350. For example, the guide member of the sheet conveyance path 321 can be extended in an approximately horizontal direction (right and left directions on a sheet surface in FIG. 2) from the sheet introducing unit 310 to the second sheet discharge unit 350.

The sheet conveyance path 322 is a sheet conveyance path which branches off downward from a branch point J of the sheet conveyance path 321, and via the sheet processing unit 330 located at the lower part of the sheet post-processing apparatus 300, leads to the first sheet discharge unit 340 located at the upper part of the sheet post-processing apparatus 300. The sheet conveyance path 322 includes a first sheet conveyance path 322*a* and a second sheet conveyance path 322*b* (hereinbelow, also simply referred to as the sheet conveyance paths 322*a* and 322*b*). The first sheet conveyance path 322*a* can include a first guide member which branches off downward from the branch point J, passes through the sheet processing unit 330, and leads to an intersecting unit 324 at which the sheet conveyance path 321 and the sheet conveyance path 322 intersect with each other. The second sheet conveyance path 322*b* can include a second guide member which is led from the intersecting unit 324 to the first sheet discharge unit 340. For example, the first guide member has an approximately U shape, and the second guide member can be extended in an approximately vertical direction (upward and downward directions on the sheet surface in FIG. 2) from the intersecting unit 324 to the first sheet discharge unit 340.

A switching gate, which is not illustrated, is disposed on the branch point J, the switching gate is controlled by the control unit 370, and thus the sheet conveyance path 321 or the sheet conveyance path 322 is selected as a conveyance path through which the sheet S advances. When the sheet conveyance path 321 is selected at the branch point J, the sheet S is conveyed along the sheet conveyance path 321 as it is and reaches the intersecting unit 324.

The intersecting unit 324 includes a sheet conveyance path 325 which branches off from the sheet conveyance path 321 and joins the sheet conveyance path 322*b*, and sheet conveyance paths 326 and 327 which respectively branch off from the sheet conveyance paths 322*a* and 322*b* and join the sheet conveyance path 321. The sheet conveyance path 326 is a sheet conveyance path for connecting the sheet conveyance path 322*a* and the sheet conveyance path 321 when the sheet S is conveyed upward along the sheet conveyance path 322*a*. The sheet conveyance path 327 is a sheet conveyance path for connecting the sheet conveyance path 322*b* and the sheet conveyance path 321 when the sheet S is conveyed downward along the sheet conveyance path 322*b*. Each branch point in the sheet conveyance paths 325 to 327 is provided with a switching gate, which is not illustrated, and the switching gate is controlled by the control unit 370.

The sheet S which is conveyed from the sheet introducing unit 310 along the sheet conveyance path 321 and reaches the intersecting unit 324 is conveyed from the sheet conveyance path 321 to the sheet conveyance path 322 via the sheet conveyance path 325 when the switching gate is switched to the sheet conveyance path 325 side. On the other hand, when the switching gate is switched to the sheet conveyance path 321 side, the sheet S is conveyed from the sheet conveyance path 321 to the second sheet discharge unit 350. Then, the sheet S is discharged from the second sheet discharge unit 350 to the outside of the sheet post-processing apparatus 300.

On the other hand, when the switching gate is switched to the sheet conveyance path 322*a* side at the branch point J, the sheet S is conveyed downward from the branch point J along the sheet conveyance path 322*a*, via the sheet processing unit 330, conveyed upward from the sheet processing unit 330, and reaches the intersecting unit 324.

When the sheet S is conveyed upward along the sheet conveyance path 322*a*, and the switching gate is switched to the sheet conveyance path 326 side at the intersecting unit 324, the sheet S is conveyed from the sheet conveyance path 322*a* to the sheet conveyance path 321 via the sheet conveyance path 326. Then, the sheet S is discharged from the second sheet discharge unit 350 to the outside of the sheet post-processing apparatus 300. On the other hand, when the sheet S is conveyed upward along the sheet conveyance path 322*a*, and the switching gate is switched to the sheet conveyance path 322*b* side at the intersecting unit 324, the sheet S is conveyed along the sheet conveyance path 322*b* to the first sheet discharge unit 340.

On the other hand, when the sheet S is conveyed downward along the sheet conveyance path 322*b*, the switching gate is switched to the sheet conveyance path 327 side at the intersecting unit 324, and the sheet S is conveyed from the sheet conveyance path 322*b* to the sheet conveyance path 321 via the sheet conveyance path 327. Then, the sheet S is discharged from the second sheet discharge unit 350 to the outside of the sheet post-processing apparatus 300.

The sheet processing unit 330 performs predetermined processing on the sheet S. According to the present embodiment, the sheet processing unit 330 includes a curl correction unit and performs curl correction on the sheet S as the above-mentioned predetermined processing. The sheet processing unit 330 can be arranged at the lower part of the sheet post-processing apparatus 300 (a lower side than the horizontal sheet conveyance path 321).

The curl correction unit includes a roller and a belt wound around the roller, forms a sheet conveyance path having a small curvature radius by the roller and the belt, and corrects curl of the sheet S by passing the sheet S through the sheet conveyance path and acting a bending force thereon.

The sheet processing unit 330 can further include a humidification unit. The humidification unit equally supplies water on both sides of the sheet S passing through the sheet conveyance path 322 to humidify the sheet S. The humidification unit can reduce rippling of the sheet S by increasing a moisture content in the sheet S.

The first sheet discharge unit 340 discharges or temporarily retreats the sheet S. The first sheet discharge unit 340 is configured to be able to discharge the sheet S to the outside of the sheet post-processing apparatus 300 and arranged at the upper part of the sheet post-processing apparatus 300. The first sheet discharge unit 340 includes a switching gate 341, a sheet discharge roller 342, a sheet discharge tray 343, and a sheet retreating unit 344.

The switching gate 341 is a switching gate for selecting whether to convey the sheet S along a purge route or along a reversing route. The purge route is a route from the switching gate 341 to the sheet discharge port passing through a sheet conveyance path 345 (a discharge route), and the reversing route is a route from the switching gate 341 to the sheet retreating unit 344, which is directed toward a direction different from the discharge route, and passes through a sheet conveyance path 346. The switching gate 341 is controlled by the control unit 370.

When the purge route is selected, the sheet S is conveyed by the sheet discharge roller 342 to the sheet discharge port and discharged onto the sheet discharge tray 343. On the other hand, when the reversing route is selected, the sheet S is conveyed toward the sheet retreating unit 344, and a part of, for example, a front end of the sheet S is temporarily retreated in the sheet retreating unit 344. The sheet retreating unit 344 includes a member for holding the part of the sheet S, for example, a pair of metal plates arranged to face each other in the approximately horizontal direction.

The second sheet discharge unit 350 is configured to be able to discharge the sheet S to the outside of the sheet post-processing apparatus 300 and arranged above the sheet processing unit 330 and below the first sheet discharge unit 340. The sheet S discharged from the second sheet discharge unit 350 can be supplied to the sheet post-processing apparatus at the post-stage.

The communication unit 360 is an interface for communicating with other devices. The above-mentioned other devices include the image forming apparatus 200 and the like.

The control unit 370 controls the sheet introducing unit 310, the sheet conveyance unit 320, the sheet processing unit 330, the first sheet discharge unit 340, the second sheet discharge unit 350, and the communication unit 360.

The control unit 370 includes a CPU as an arithmetic processing unit (not illustrated) and a RAM and a ROM as storage units (not illustrated). The above-mentioned arithmetic processing unit executes a control program for the sheet post-processing apparatus 300 and outputs an instruction to each of the sheet introducing unit 310, the sheet conveyance unit 320, the sheet processing unit 330, the first sheet discharge unit 340, the second sheet discharge unit 350, and the communication unit 360. The above-mentioned storage units store the above-mentioned control program, various parameters, and the like.

According to the present embodiment, a user can edit print setting data via a printer driver operating on the above-mentioned client terminal and set selection of the discharge unit and necessity of execution of post-processing and reversing of front and back sides with respect to each of the sheets S introduced into the sheet post-processing apparatus 300. The above-mentioned discharge unit is either one of the first sheet discharge unit 340 and the second sheet discharge unit 350.

For example, a user can set to reverse front and back sides of the introduced sheet S and discharge the sheet S from the second sheet discharge unit 350 to the outside. Further, a user can set to perform the post-processing on the introduced sheet S, reverse the front and back sides of the sheet S subjected to the post-processing, and discharge the sheet S from the second sheet discharge unit 350 to the outside.

With reference to FIGS. 3 to 9, each sheet conveyance route is described in detail below through which the sheet S introduced into the sheet post-processing apparatus 300 is discharged to the outside by the first sheet discharge unit 340 or the second sheet discharge unit 350.

[First Route]

Figure 3:
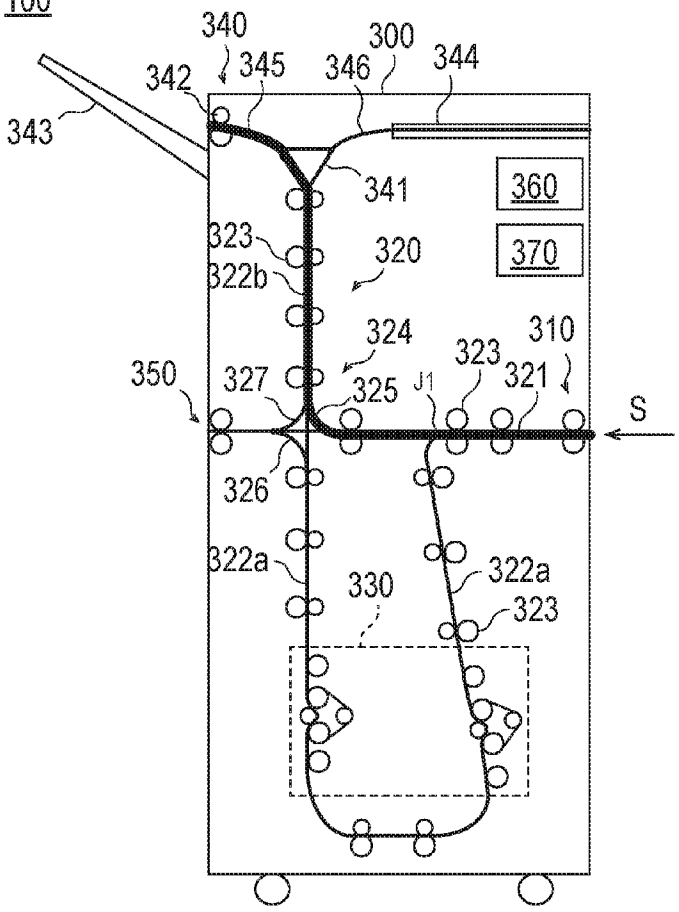
FIG. 3 is a cross-sectional view illustrating when a sheet introduced into the sheet post-processing apparatus is discharged to the outside of the sheet post-processing apparatus through a first route.

FIG. 3 is a cross-sectional view illustrating when the sheet S introduced into the sheet post-processing apparatus 300 is discharged to the outside of the sheet post-processing apparatus 300 through a first route. In FIG. 3, the first route is a sheet conveyance route indicated by a thick line.

In the first route, the sheet S is discharged by the first sheet discharge unit 340 without being subjected to the post-processing and reversing the front and back sides of the sheet S. More specifically, the sheet S introduced by the sheet introducing unit 310 is conveyed along the sheet conveyance path 321 to the intersecting unit 324, via the sheet conveyance path 325 at the intersecting unit 324, and is conveyed along the sheet conveyance path 322*b* to the first sheet discharge unit 340. The sheet S passes through the purge route in the first sheet discharge unit 340 and is discharged onto the sheet discharge tray 343.

[Second Route]

Figure 4:
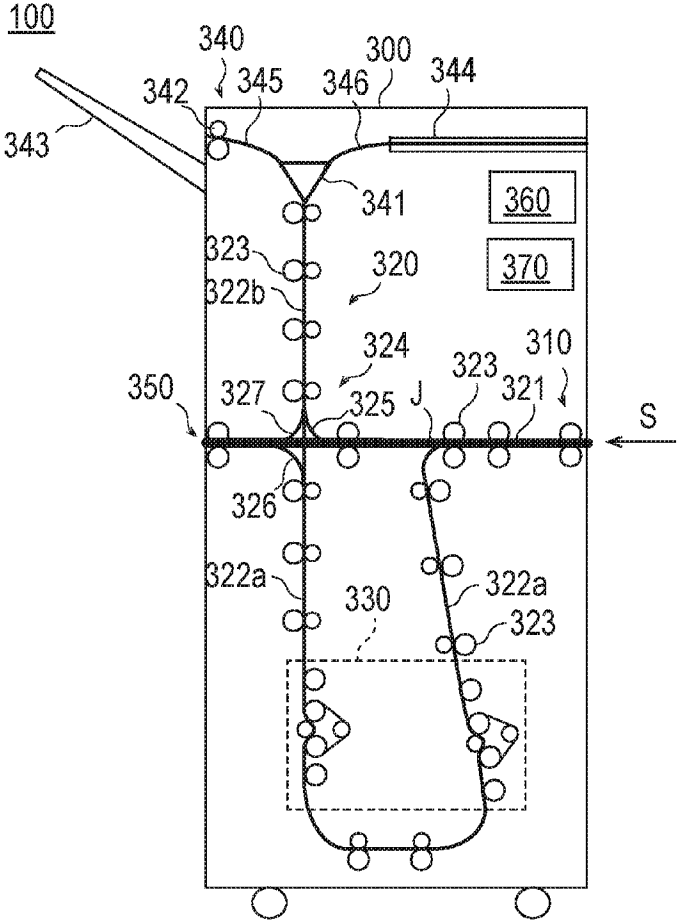
FIG. 4 is a cross-sectional view illustrating when a sheet introduced into the sheet post-processing apparatus is discharged to the outside of the sheet post-processing apparatus through a second route.

FIG. 4 is a cross-sectional view illustrating when the sheet S introduced into the sheet post-processing apparatus 300 is discharged to the outside of the sheet post-processing apparatus 300 through a second route. In FIG. 4, the second route is a sheet conveyance route indicated by a thick line.

In the second route, the sheet S is discharged by the second sheet discharge unit 350 without being subjected to the post-processing and reversing the front and back sides of the sheet S. More specifically, the sheet S introduced by the sheet introducing unit 310 is conveyed along the sheet conveyance path 321 to the second sheet discharge unit 350 and discharged to the outside of the sheet post-processing apparatus 300.

[Third Route]

Figure 5:
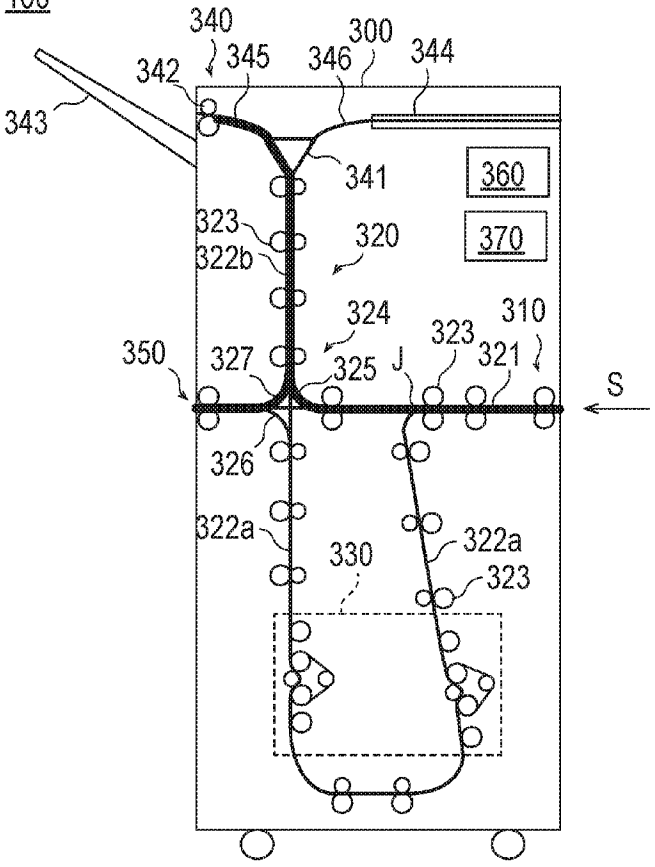
FIG. 5 is a cross-sectional view illustrating when a sheet introduced into the sheet post-processing apparatus is discharged to the outside of the sheet post-processing apparatus through a third route.

FIG. 5 is a cross-sectional view illustrating when the sheet S introduced into the sheet post-processing apparatus 300 is discharged to the outside of the sheet post-processing apparatus 300 through a third route. In FIG. 5, the third route is a sheet conveyance route indicated by a thick line.

In the third route, the sheet S is not subjected to the post-processing but the front and back sides of the sheet S are reversed, and discharged by the second sheet discharge unit 350. The processing is specifically described below.

The sheet S introduced by the sheet introducing unit 310 is conveyed along the sheet conveyance path 321 to the intersecting unit 324, passes through the sheet conveyance path 325 at the intersecting unit 324, and is conveyed upward along the sheet conveyance path 322*b* toward the first sheet discharge unit 340.

When a length of the sheet S in a conveyance direction is equal to or less than a predetermined length, the control unit 370 switches the switching gate 341 to the purge route side (the sheet conveyance path 345 side), and reverses the front and back sides of the sheet S using, for example, the sheet conveyance path 322*b* that extends from the intersecting unit 324 to the switching gate 341. The length of the sheet S in the conveyance direction is short, therefore the sheet S is not discharged from the first sheet discharge unit 340 to the outside. In this regard, the above-mentioned predetermined length can be set to, for example, a length of an A4 cut sheet (A4 vertical) in the sheet conveyance direction. A distance from the intersecting unit 324 to the sheet discharge roller 342 through the sheet conveyance path 345 is equivalent to or slightly longer than the length of the A4 cut sheet in the sheet conveyance direction. Information regarding the sheet S is transmitted to the control unit 370 via the communication unit 280 of the image forming apparatus 200 and the communication unit 360 of the sheet post-processing apparatus 300.

The control unit 370 controls the sheet conveyance unit 320 to convey the sheet S toward the first sheet discharge unit 340 to a position at which a rear end of the sheet S exits from the intersecting unit 324 to the sheet conveyance path 322*b*. When the rear end of the sheet S reaches the position exiting from the intersecting unit 324 to the sheet conveyance path 322*b*, the control unit 370 conveys the sheet S to an opposite direction toward the second sheet discharge unit 350, in other words, conveys the sheet S downward along the sheet conveyance path 322*b* in such a manner that the rear end of the sheet S so far will be in a front end direction and discharges the sheet S from the second sheet discharge unit 350.

[Fourth Route]

Figure 6:
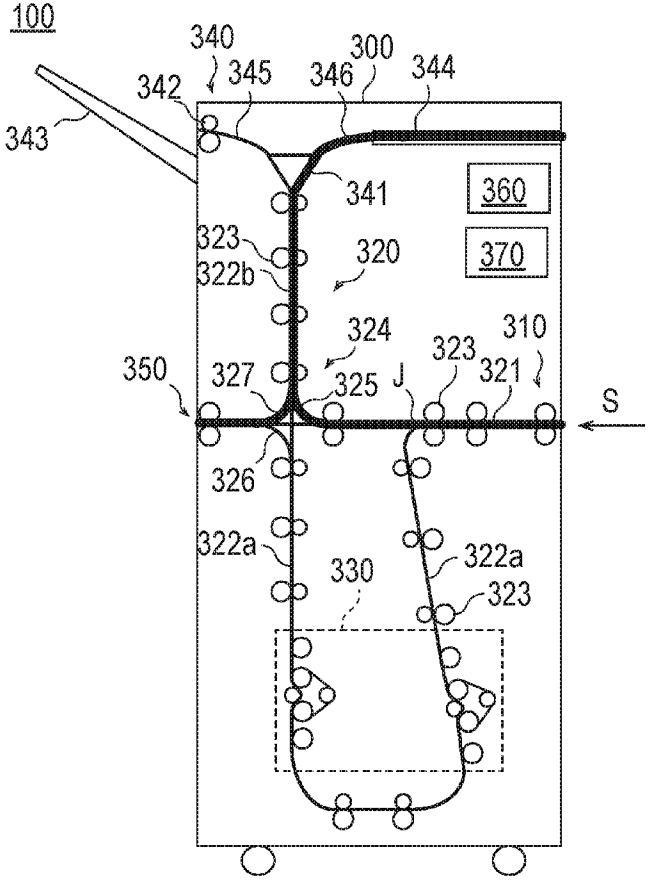
FIG. 6 is a cross-sectional view illustrating when a sheet introduced into the sheet post-processing apparatus is discharged to the outside of the sheet post-processing apparatus through a fourth route.

FIG. 6 is a cross-sectional view illustrating when the sheet S introduced into the sheet post-processing apparatus 300 is discharged to the outside of the sheet post-processing apparatus 300 through a fourth route. In FIG. 6, the fourth route is a sheet conveyance route indicated by a thick line.

In the fourth route, the sheet S is not subjected to the post-processing but the front and back sides of the sheet S are reversed, and is discharged from the second sheet discharge unit 350 as with the case of the third route. However, in the fourth route, unlike the third route, the length of the sheet S in the conveyance direction is longer than the predetermined length, therefore the sheet S is partially and temporarily retreated in the sheet retreating unit 344 and then conveyed toward the second sheet discharge unit 350. The processing is specifically described below.

The sheet S introduced by the sheet introducing unit 310 is conveyed along the sheet conveyance path 321 to the intersecting unit 324, passes through the sheet conveyance path 325 at the intersecting unit 324, and is conveyed along the sheet conveyance path 322*b* toward the first sheet discharge unit 340.

When the length of the sheet S in the conveyance direction is longer than the predetermined length, the control unit 370 switches the switching gate 341 to the reversing route side and conveys the sheet S toward the sheet retreating unit 344 until the rear end of the sheet S reaches the position exiting from the intersecting unit 324 to the sheet conveyance path 322*b*. The front end of the sheet S is inserted into the sheet retreating unit 344 and temporarily retreated. Therefore, the sheet S is not discharged from the first sheet discharge unit 340 to the outside. A distance from the intersecting unit 324 to an end of the sheet retreating unit 344 along the sheet conveyance path 322*b* via the switching gate 341 is sufficiently longer than a length of the sheet S having a maximum feedable size in the conveyance direction.

Subsequently, when the rear end of the sheet S reaches the position exiting from the intersecting unit 324 to the sheet conveyance path 322*b*, the control unit 370 conveys the sheet S to the opposite direction toward the second sheet discharge unit 350, in other words, conveys the sheet S downward along the sheet conveyance path 322*b* and discharges the sheet S from the second sheet discharge unit 350.

[Fifth Route]

Figure 7:
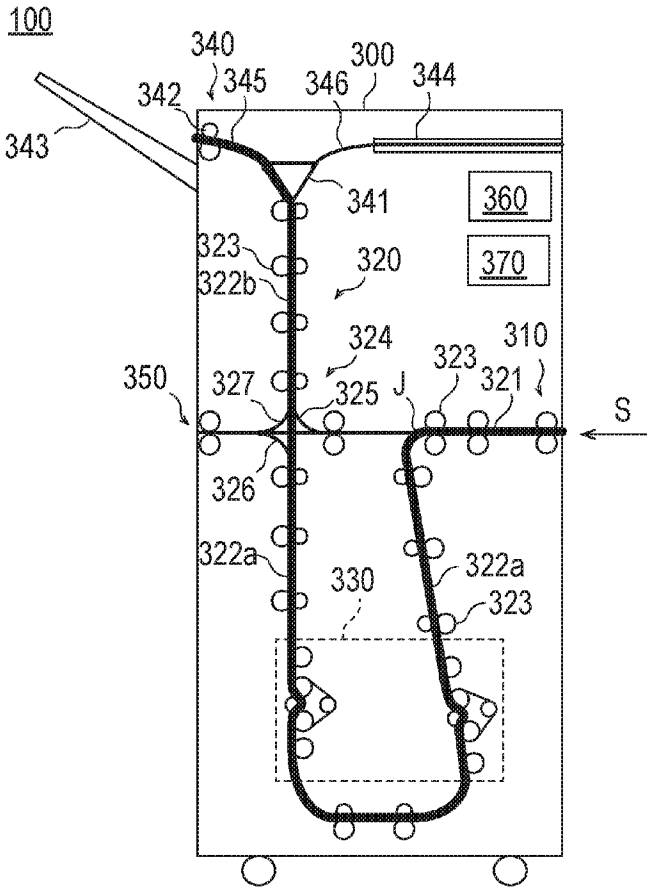
FIG. 7 is a cross-sectional view illustrating when a sheet introduced into the sheet post-processing apparatus is discharged to the outside of the sheet post-processing apparatus through a fifth route.

FIG. 7 is a cross-sectional view illustrating when the sheet S introduced into the sheet post-processing apparatus 300 is discharged to the outside of the sheet post-processing apparatus 300 through a fifth route. In FIG. 7, the fifth route is a sheet conveyance route indicated by a thick line.

In the fifth route, the sheet S is subjected to the post-processing and then discharged from the first sheet discharge unit 340 without reversing the front and back sides of the sheet S. The processing is specifically described below.

The sheet S introduced by the sheet introducing unit 310 is conveyed along the sheet conveyance path 321 to the branch point J and conveyed downward from the branch point J along the sheet conveyance path 322*a* toward the sheet processing unit 330.

The control unit 370 conveys the sheet S along the sheet conveyance path 322*a* and also controls the sheet processing unit 330 to correct curl of the sheet S. The control unit 370 conveys the curl-corrected sheet S toward the first sheet discharge unit 340 and discharges the sheet S from the first sheet discharge unit 340 to the outside of the sheet post-processing apparatus 300 through the purge route.

[Sixth Route]

Figure 8:
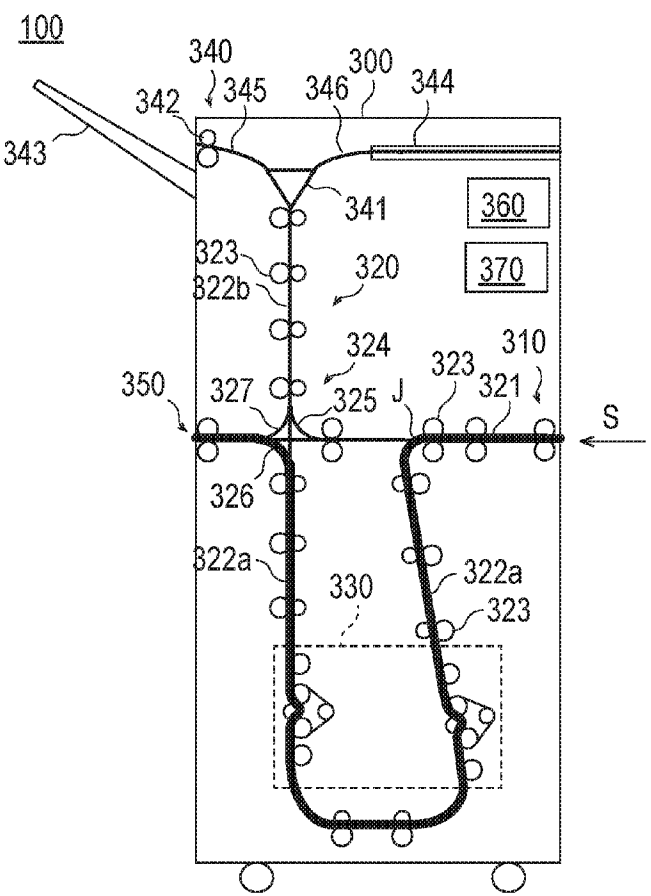
FIG. 8 is a cross-sectional view illustrating when a sheet introduced into the sheet post-processing apparatus is discharged to the outside of the sheet post-processing apparatus through a sixth route.

FIG. 8 is a cross-sectional view illustrating when the sheet S introduced into the sheet post-processing apparatus 300 is discharged to the outside of the sheet post-processing apparatus 300 through a sixth route. In FIG. 8, the sixth route is a sheet conveyance route indicated by a thick line.

In the sixth route, the sheet S is subjected to the post-processing and then discharged from the second sheet discharge unit 350 without reversing the front and back sides of the sheet S. The processing is specifically described below.

The sheet S introduced by the sheet introducing unit 310 is conveyed along the sheet conveyance path 321 to the branch point J and conveyed downward from the branch point J along the sheet conveyance path 322*a* toward the sheet processing unit 330.

The control unit 370 conveys the sheet S along the sheet conveyance path 322*a* and also controls the sheet processing unit 330 to correct curl of the sheet S. The control unit 370 conveys the curl-corrected sheet S toward the second sheet discharge unit 350 and discharges the sheet S from the second sheet discharge unit 350 to the outside of the sheet post-processing apparatus 300.

[Seventh Route]

Figure 9:
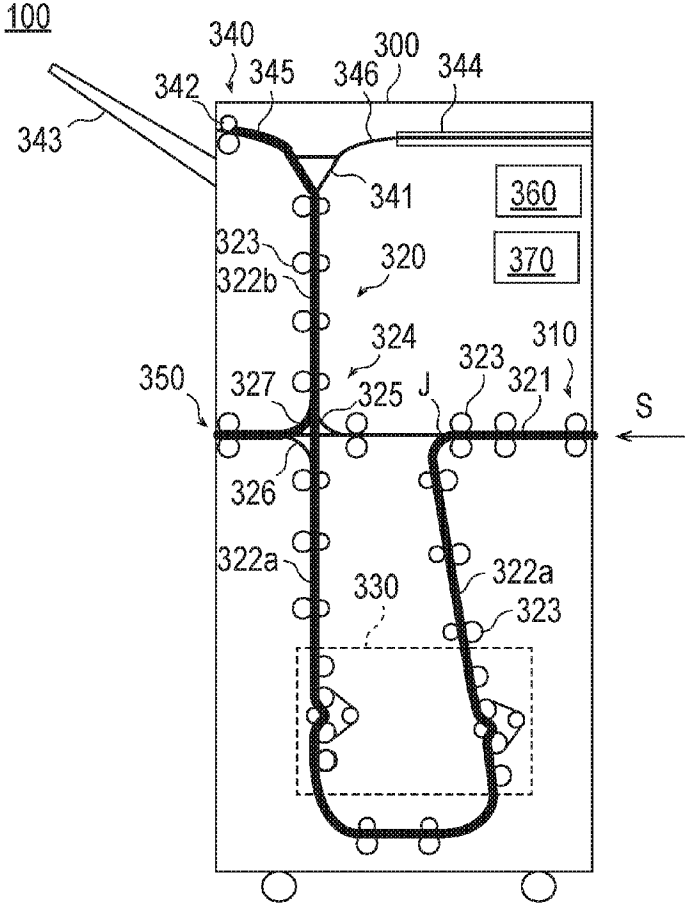
FIG. 9 is a cross-sectional view illustrating when a sheet introduced into the sheet post-processing apparatus is discharged to the outside of the sheet post-processing apparatus through a seventh route.

FIG. 9 is a cross-sectional view illustrating when the sheet S introduced into the sheet post-processing apparatus 300 is discharged to the outside of the sheet post-processing apparatus 300 through a seventh route. In FIG. 9, the seventh route is a sheet conveyance route indicated by a thick line.

In the seventh route, the sheet S is subjected to the post-processing, then the front and back sides of the sheet S are reversed, and the sheet S is discharged from the second sheet discharge unit 350. The processing is specifically described below.

The sheet S introduced by the sheet introducing unit 310 is conveyed along the sheet conveyance path 321 to the branch point J and conveyed downward from the branch point J along the sheet conveyance path 322*a* toward the sheet processing unit 330.

The control unit 370 conveys the sheet S along the sheet conveyance path 322*a* and also controls the sheet processing unit 330 to correct curl of the sheet S. The control unit 370 conveys the curl-corrected sheet S toward the first sheet discharge unit 340, and, when the length of the sheet S in the conveyance direction is equal to or less than the predetermined length, reverses the front and back sides of the sheet S using, for example, the sheet conveyance path 322*b* between the intersecting unit 324 and the switching gate 341.

The control unit 370 controls the sheet conveyance unit 320 to convey the sheet S toward the first sheet discharge unit 340 to the position at which the rear end of the sheet S exits from the intersecting unit 324 to the sheet conveyance path 322*b*. When the rear end of the sheet S reaches the position exiting from the intersecting unit 324 to the sheet conveyance path 322*b*, the control unit 370 conveys the sheet S to the opposite direction toward the second sheet discharge unit 350, in other words, conveys the sheet S downward along the sheet conveyance path 322*b* in such a manner that the rear end of the sheet S so far will be in the front end direction and discharges the sheet S from the second sheet discharge unit 350.

[Eighth Route]

Figure 10:
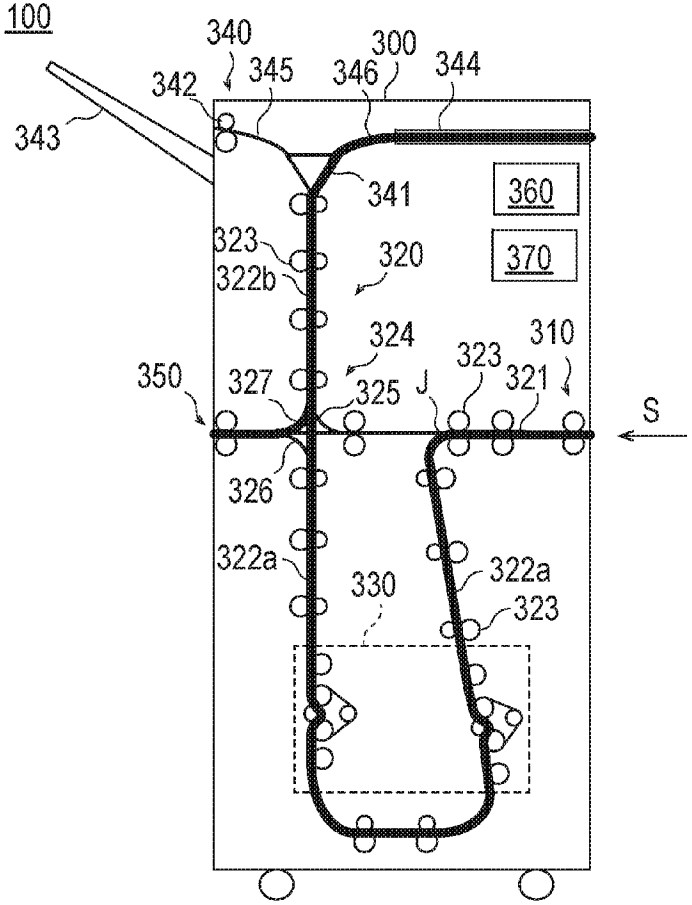
FIG. 10 is a cross-sectional view illustrating when a sheet introduced into the sheet post-processing apparatus is discharged to the outside of the sheet post-processing apparatus through an eighth route.

FIG. 10 is a cross-sectional view illustrating when the sheet S introduced into the sheet post-processing apparatus 300 is discharged to the outside of the sheet post-processing apparatus 300 through an eighth route. In FIG. 10, the eighth route is a sheet conveyance route indicated by a thick line.

In the eighth route, the sheet S is subjected to the post-processing, then the front and back sides of the sheet S are reversed, and the sheet S is discharged from the second sheet discharge unit 350 as with the case of the seventh route. However, in the eighth route, unlike the seventh route, the length of the sheet S in the conveyance direction is longer than the predetermined length, thus the sheet S is partially and temporarily retreated in the sheet retreating unit 344 and then conveyed toward the second sheet discharge unit 350. The processing is specifically described below.

The sheet S introduced by the sheet introducing unit 310 is conveyed along the sheet conveyance path 321 to the branch point J and conveyed downward from the branch point J along the sheet conveyance path 322*a* toward the sheet processing unit 330.

The control unit 370 while conveying the sheet S along the sheet conveyance path 322*a*, controls the sheet processing unit 330 to correct curl of the sheet S, and conveys the curl-corrected sheet S toward the first sheet discharge unit 340.

Subsequently, when the length of the sheet S in the conveyance direction is longer than the predetermined length, the control unit 370 switches the switching gate 341 to the reversing route side and conveys the sheet S toward the sheet retreating unit 344 until the rear end of the sheet S reaches the position exiting from the intersecting unit 324 to the sheet conveyance path 322*b*. The front end of the sheet S is inserted into the sheet retreating unit 344 and temporarily retreated.

When the rear end of the sheet S reaches the position exiting from the intersecting unit 324 to the sheet conveyance path 322*b*, the control unit 370 conveys the sheet S to the opposite direction toward the second sheet discharge unit 350 and discharges the sheet S from the second sheet discharge unit 350.

As described above, each sheet conveyance route is described through which the sheet S introduced into the sheet post-processing apparatus 300 is discharged from the first sheet discharge unit 340 or the second sheet discharge unit 350 to the outside. The sheet post-processing apparatus 300 can selectively perform the post-processing on the sheet S and reversing of the front and back sides of the introduced sheet S.

As described above in the third and the fourth routes, when the sheet S is not subjected to the post-processing but the front and back sides of the sheet S are reversed, the sheet S is conveyed from the sheet conveyance path 321 toward the first sheet discharge unit 340 via the sheet conveyance path 325 along the sheet conveyance path 322. Further, as described above in the seventh and the eighth routes, when the front and back sides of the sheet S are reversed after the sheet S is subjected to the post-processing, the sheet S is conveyed from the sheet processing unit 330 along the sheet conveyance path 322 toward the first sheet discharge unit 340. The control unit 370 controls the sheet conveyance unit 320 to convey the sheet S to a predetermined position at which the sheet S is not discharged to the outside from the first sheet discharge unit 340 toward the first sheet discharge unit 340, then convey the sheet S to the opposite direction toward the second sheet discharge unit 350, and discharge the sheet S from the second sheet discharge unit 350.

Further, the control unit 370 determines whether to temporarily retreat a part of the sheet S in the sheet retreating unit 344 depending on the length of the sheet S in the conveyance direction. In the case that the length of the sheet S in the conveyance direction is equal to or less than the predetermined length, the sheet S is drawn into the purge route and conveyed to the above-described predetermined position. This is because the length of the sheet S is short, and the front end of the sheet S does not protrude from the sheet discharge port of the first sheet discharge unit 340.

On the other hand, in the case that the length of the sheet S in the conveyance direction is longer than the predetermined length, if the sheet S is drawn into the purge route and conveyed to the above-described predetermined position, there is a possibility that the front end of the sheet S protrudes from the sheet discharge port of the first sheet discharge unit 340. Therefore, the control unit 370 switches the switching gate 341 to the reversing route side to temporarily retreat a part of the sheet S in the sheet retreating unit 344 and then conveys the sheet S toward the second sheet discharge unit 350.

As described above, the sheet conveyance unit 320 (especially, the sheet conveyance path 322*b*), the first sheet discharge unit 340, and the control unit 370 function as sheet reversing units. The sheet reversing unit according to the present embodiment conveys the sheet S upward along the sheet conveyance path 322*b* and then conveys the sheet S downward along the sheet conveyance path 322*b* to interchange the front and rear ends of the sheet S, so that the front and back sides of the sheet S are reversed. In other words, the above-mentioned sheet reversing unit is formed upwardly at the upper part of the sheet post-processing apparatus 300 and arranged so as not to overlap with the sheet processing unit 330 arranged at the lower part of the sheet post-processing apparatus 300. More specifically, the sheet processing unit 330 and the above-mentioned sheet reversing unit are not arranged side by side in the horizontal direction but arranged side by side in a vertical direction. Therefore, the sheet post-processing apparatus 300 can be prevented from being enlarged in the horizontal direction.

Accordingly, the above-described present embodiment can provide the following effect.

In the sheet post-processing apparatus 300 according to the present embodiment, the sheet conveyance path 322*b* used as a conveyance route to the first sheet discharge unit 340 can also function as the sheet reversing unit for reversing the front and back sides of the sheet S, and thus there is no need to newly install the sheet reversing unit. Therefore, the present embodiment can prevent enlargement of the apparatus and a decrease in productivity. Further, the first sheet discharge unit 340 connected to the sheet conveyance path 322*b* includes the sheet retreating unit 344, and thus when the length of the sheet S in the conveyance direction is longer than the predetermined length, a part of the sheet S can be retreated in the sheet retreating unit 344. Therefore, unlike the conventional technique of discharging a part of the sheet S to the sheet discharge tray 343, the present embodiment can prevent the sheet S from flip-flopping on the front end thereof by receiving a lifting force and the like, curling by receiving air resistance, or wrinkling when the sheet S is pulled back. Accordingly, the sheet post-processing apparatus 300 according to the present embodiment can discharge the sheet by stably reversing front and back sides thereof.

Thus, the embodiment of the sheet post-processing apparatus 300 and the image forming system 100 including the sheet post-processing apparatus 300 according to the present invention is described above. However, it is needless to say that the present invention can be practiced with appropriate addition, modifications, and omission by a person skilled in the art within the scope of the technical idea.

For example, according to the above-described embodiment, a case is described in which the sheet processing unit includes the curl correction unit and the humidification unit, however, the present invention is not limited to the case in which the sheet processing unit includes the curl correction unit and the humidification unit. The sheet processing unit can include a post-processing mechanism other than the curl correction unit and the humidification unit.

What is claimed is:

1. A sheet post-processing apparatus including a function of performing predetermined processing on a sheet introduced from an outside, then reversing front and back sides of the sheet, and discharging the sheet to the outside, the sheet post-processing apparatus comprising:

a sheet introducing unit configured to introduce the sheet;

a first sheet discharge unit configured to be able to discharge the sheet to the outside;

a second sheet discharge unit located below the first sheet discharge unit and configured to be able to discharge the sheet to the outside;

a sheet processing unit configured to perform the predetermined processing on the sheet;

a sheet conveyance unit which includes a sheet conveyance path arranged between the first sheet discharge unit and the second sheet discharge unit and is configured to convey the sheet through the sheet conveyance path; and a control unit configured to, in the case where the front and back sides of the sheet are reversed and the sheet is discharged from the second sheet discharge unit to the outside, control the sheet conveyance unit to convey the sheet toward an intersecting unit, which is closer to the second sheet discharge unit than to the first sheet discharge unit, then convey the sheet, along the sheet conveyance path, toward the first sheet discharge unit to a predetermined position at which the sheet is not discharged from the first sheet discharge unit to the outside, then convey the sheet along the sheet conveyance path in an opposite direction toward the second sheet discharge unit, and discharge the sheet from the second sheet discharge unit, wherein the first sheet discharge unit comprises a sheet retreating unit configured to retreat the sheet conveyed toward a direction different from a discharge route to the outside, and the control unit controls in the case where a length of the sheet in a conveyance direction is longer than a predetermined length, the sheet conveyance unit and the first sheet discharge unit to convey the sheet toward the sheet retreating unit, temporarily retreat a part of the sheet in the sheet retreating unit, then convey the sheet in an opposite direction toward the second sheet discharge unit, and discharge the sheet from the second sheet discharge unit.

2. The sheet post-processing apparatus as claimed in claim 1, wherein the first sheet discharge unit comprises a switching gate configured to select whether to convey the sheet along the discharge route or whether to convey the sheet along a reversing route to the sheet retreating unit depending on the length of the sheet in the conveyance direction.

3. The sheet post-processing apparatus as claimed in claim 1, wherein the sheet conveyance path extends from the second sheet discharge unit to the first sheet discharge unit located above the second sheet discharge unit.

4. The sheet post-processing apparatus as claimed in claim 3, wherein the sheet processing unit is arranged below the sheet conveyance path.

5. The sheet post-processing apparatus as claimed in claim 1, wherein the sheet processing unit comprises a curl correction unit configured to correct curl of the sheet.

6. An image forming system comprising:

the sheet post-processing apparatus as claimed in claim 1; and an image forming apparatus configured to form an image on a sheet and supply the sheet on which the image is formed to the sheet post-processing apparatus.

* * * * *